US007360805B1

(12) United States Patent
Brown

(10) Patent No.: US 7,360,805 B1
(45) Date of Patent: Apr. 22, 2008

(54) DOUBLE LOCK SLIDING DOOR

(76) Inventor: Michael O. Brown, 17311 NW. 46th Ave., Miami, FL (US) 33055

( * ) Notice: Subject to any disclaimer, the term of this patent is extended or adjusted under 35 U.S.C. 154(b) by 0 days.

(21) Appl. No.: 11/446,856

(22) Filed: Jun. 5, 2006

(51) Int. Cl.
*E05C 19/18* (2006.01)

(52) U.S. Cl. ..... 292/289; 292/259 R; 292/DIG. 46

(58) Field of Classification Search ..... 292/289, 292/338, 339, 290, 292 X, 295, 296, 297, 292/DIG. 46 X, 259 R; 70/94, 101, DIG. 64–DIG. 66
See application file for complete search history.

(56) References Cited

U.S. PATENT DOCUMENTS 4,318,559 A * 3/1982 Burton ..... 292/263
4,572,557 A * 2/1986 Taylor ..... 292/263
4,792,168 A * 12/1988 Kardosh ..... 292/288
4,798,407 A 1/1989 Miller
4,993,761 A 2/1991 Paskert
5,685,582 A * 11/1997 McCartney ..... 292/339
D398,831 S * 9/1998 Walton ..... D8/339
6,340,184 B1 * 1/2002 Kuzmich ..... 292/259 R
6,474,707 B1 * 11/2002 Simonis ..... 292/259 R

* cited by examiner

*Primary Examiner*—Patricia Engle
*Assistant Examiner*—Mark Williams
(74) *Attorney, Agent, or Firm*—T.L. Garrett, PLC; Tanya L. Garrett

(57) ABSTRACT

A double lock system for use combination with sliding door assemblies to prevent unwanted movement of the door assembly. The double lock system, a user, such as a home-owner provides a tubing having sleeves that interface and engage the tubing into a bracket assembly and then locks all the parts together with locking pins. The door lock system has a tubing section that interfaces with at least one sleeve to adjust an overall width of the tubing and sleeve combination; and a bracket assembly securely mounted to the door assembly for receiving and retaining the tubing and sleeve combination in a fixed position relative to the door assembly.

7 Claims, 4 Drawing Sheets

DOUBLE LOCK SLIDING DOOR

FIELD OF THE INVENTION

The present invention generally relates to a locking system for use in the field of securely locking sliding door assemblies.

BACKGROUND

The use of devices and methods relating to locking devices associated with sliding door assemblies and with adjustable locking assemblies are disclosed in U.S. Pat. No. 5,685,582 issued in the name of McCartney, U.S. Pat. No. 4,572,557 issued in the name of Taylor, U.S. Pat. No. 4,798,407 issued in the name of Miller, U.S. Pat. No. 4,792,168 issued in the name of Kardosh, and U.S. Pat. No. 4,993,761 issued in the name of Paskert.

While existing devices suit their intended purpose, the need remains for a device and method that is

SUMMARY

In one aspect of the technology, a double lock system is provided to secure a sliding door assembly in a fixed position thereby preventing unwanted movement of the door assembly. Generally, the door lock system has a tubing section that interfaces with at least one sleeve to adjust an overall width of the tubing and sleeve combination; and a bracket assembly securely mounted to the door assembly for receiving and retaining the tubing and sleeve combination in a fixed position relative to the door assembly.

A method of using the door lock system device is also provided.

BRIEF DESCRIPTION OF THE DRAWINGS

These and other objects, features and advantages of the present invention will become apparent from the following detailed description and the appended drawings in which.

DETAILED DESCRIPTION OF THE INVENTION

The present area of technology is directed to a double lock system for securing a sliding glass door assembly. The double lock system provides convenience, ease of installation/use, structural strength, lightweight, optimum size, timesavings, and may be manufactured and thus sold for reasonable prices. Homeowners may find the unique lock helpful, to prevent any unauthorized entry through a sliding glass door.

In operation, when a door is secured using the double lock system, a user, such as a homeowner may slip a bar formed by tubing having sleeves that interface and engage the tubing into a bracket assembly and then lock all the parts together with locking pins.

Figure 1:
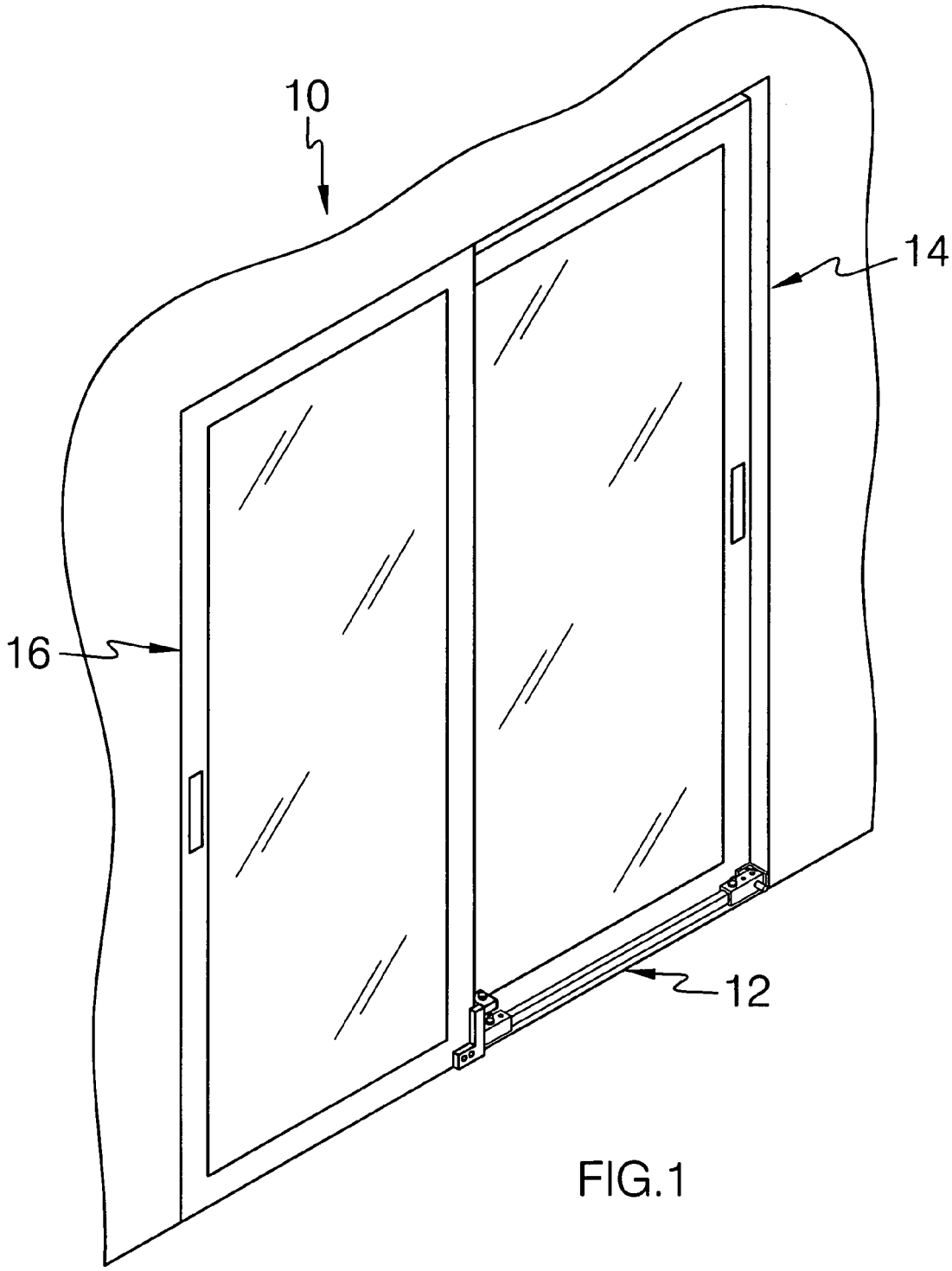
FIG. 1 illustrates a perspective view of a sliding door assembly secured in a double locked position through use of a double lock system.
Figure 2:
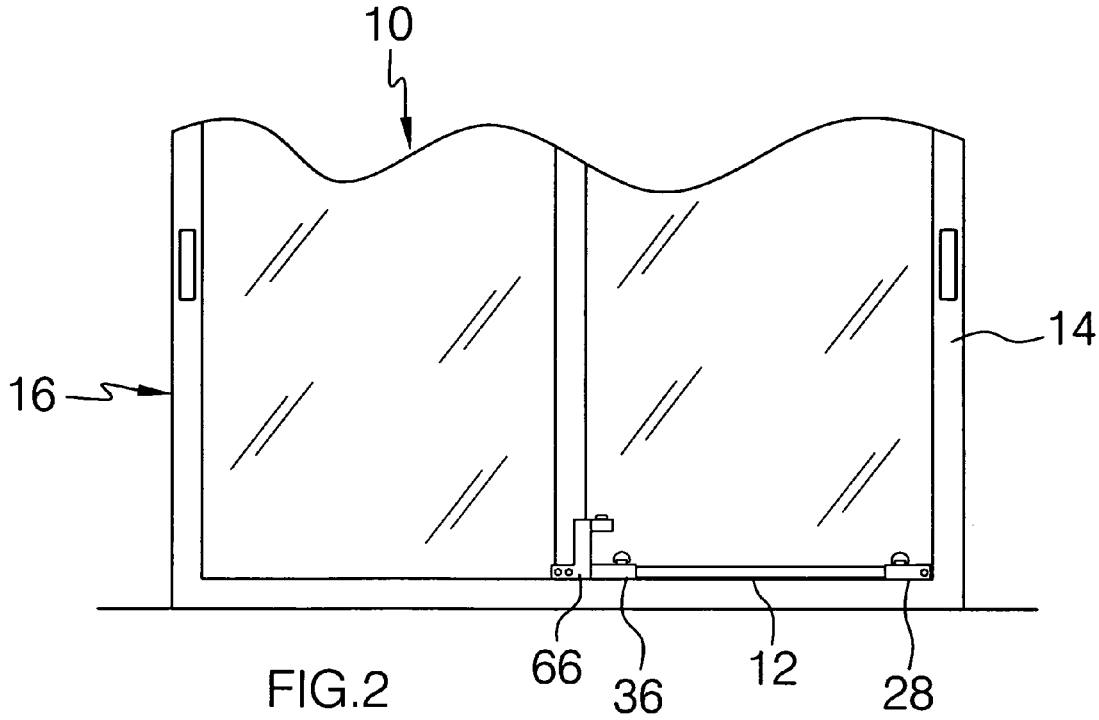
FIG. 2 illustrates a partial front view of the sliding door assembly and double lock system shown in FIG. 1.

Referring now to the drawings, FIG. 1 illustrates a perspective view of a sliding door assembly 10 secured in a double locked position through use of a double lock system 12. FIG. 2 illustrates a partial front view of the sliding door assembly 10 and double lock system 12 shown in FIG. 1.

The sliding door assembly has a stationary door 14 and a movable door 16 which moves on slides in a lateral manner with respect to the stationary door.

The lock system as shown in FIGS. 1-2 locks both ends of a glass sliding door. Increased security is provided by double locking the stationary door 14 at both ends of the door 14.

In one aspect of the technology, the double lock system may be installed to fit within existing glass doors. Alternatively, in another aspect of the technology, the double lock system may be built within to the frame of the door.

The double lock system 12 provides a tubing section, at least one or more sleeves, and a bracket assembly (shown in FIG. 3) adapted to receive the at least one or more sleeves, wherein each of the locking system elements cooperate to secure the locking system in a fixed position relative to the sliding door assembly.

The tubing section may be simply slipped into an existing frame on the stationary door of a conventional sliding door assembly. The lock system may then be secured in place, to provide an increased level of security for a homeowner.

The tubing 18 may have a square or rectangular cross-section that may be made of any suitable rigid material that has come or may come into existence such as, but not limited to steel. Additionally, the tubing 18 may be any suitable dimension adapted to fit within the stationary door. A non-limiting length dimension of the tubing 18 may be 34 inches, and a suitable non-limiting height or width of the tubing cross-section, if square shaped may be 1.25 inches.

Figure 5:
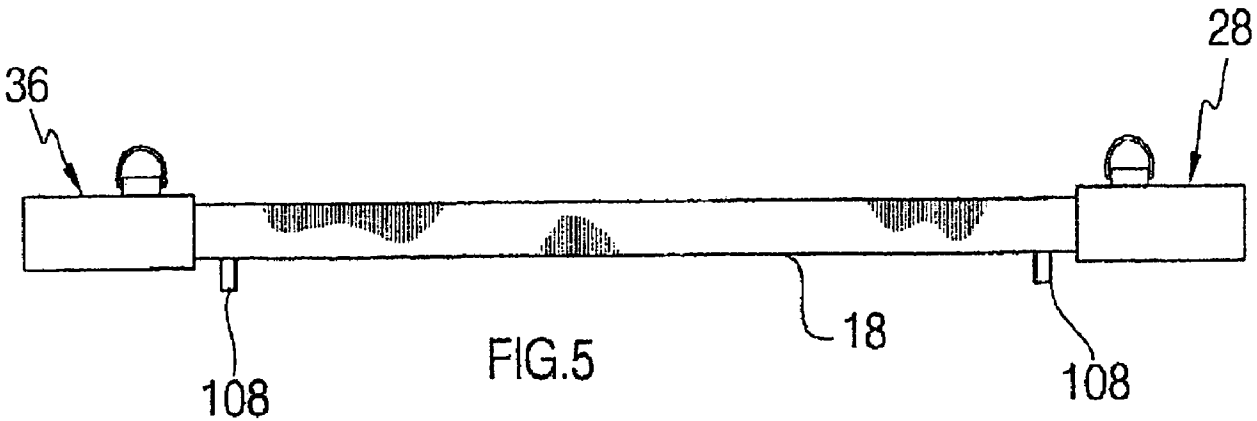
FIG. 5 illustrates a front elevational view of the tubing having two opposing ends each respectively disposed within the sleeves respectively.
Figure 6:
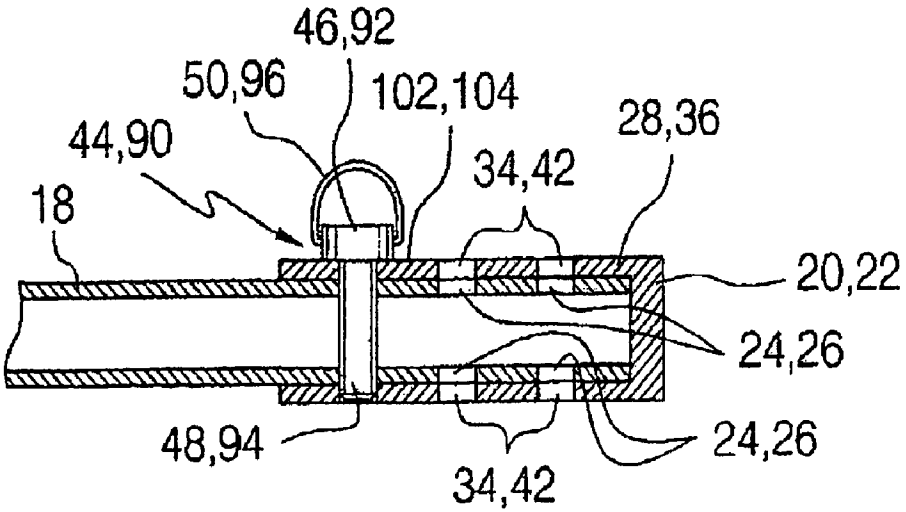
FIG. 6 illustrates a cut-away partial cross-sectional view of the tubing and sleeve combination shown in FIG. 5.

FIGS. 5 and 6 illustrate a more detailed view of the tubing 18 in combination with the sleeves 28, 36. More particularly, FIG. 5 illustrates a front elevational view of the tubing 18 having two opposing ends 20, 22 each respectively disposed within the sleeves 28, 36, respectively. FIG. 6 illustrates a cut-away partial cross-sectional view of the tubing and sleeve combination shown in FIG. 5.

The tubing 18 has a first end 20 and a second end 22, wherein each of the ends 20, 22 of the tubing 18 are associated with a corresponding first and second sleeve 28, 36 that each engage the respective first and second ends 20, 22 of the tubing 18.

Also, the tubing has an associated plurality of holes 24, 26 associated with each of the first and second ends 20, 22 of the tubing 18, respectively. Additionally, each of the first and second sleeves 28, 36 also have one or more holes 34, 42, respectively that correspond to the one or more holes 24, 26 in the tubing 18. The plurality of holes in the sleeves and tubing are provided for length adjustment of the tubing 18 in combination with the sleeve.

The first and a second sleeves 28, 36 are each adapted to complementary engage and receive each of the first and second ends 20, 22 of the tubing 18, respectively. Each of the sleeves 28, 36 operate to lock both ends 20, 22 of the tubing 18 in place at a bottom of the stationary door 14 wherein the two sleeves may vary in dimension in accordance with a size of the tubing and the width of the door. A suitable length of the sleeve may be, but is not limited to about three inches.

As shown for illustrative purposes in FIG. 6, the one or more holes 34, 42 in each of the sleeves 28, 36 are each adapted to be aligned with a corresponding hole 24, 26 disposed through the tubing such that an associated locking pin 44, 90 is disposed through both the holes 34, 24 and 42, 26, respectively. Each sleeve 28, 36 has an associated closed end 32, 40 and an associated open end 30, 38 each adapted to receive a respective end 20, 22, respectively of the tubing 18 therewithin.

Additionally, each sleeve 28, 36 may have an optional pin 98, 100 protruding outwardly from a lateral or a top portion of the associated sleeve 28, 36 adapted to be easily grasped by a user for slidably moving the associated sleeve 20, 22 in a lateral direction with respect to the tubing 18. Thus, the length of the tubing 18 may be adjusted between and including a first, and a second position and an intermediary position between the first and the second position.

An optional grommet (not shown) may be provided within a respective hole of the sleeve into which the locking pin 44, 90 would slide to securely retain the locking pin 44, 90 therethrough. The grommet may be made of any suitable resilient material adapted to fit within each respective hole associated with the sleeve that has come or may come into existence such as, but not limited to rubber.

Each locking pin 44, 90 has an associated locking pin head 46, 92 that engages an associated planar surface 102, 104 of an associated sleeve 28, 36 when assembled with the respective sleeve 28, 36; a protruding inwardly and downwardly from the head 46, 92 when locked in position within the double lock system 12; and a locking pin shaft 48 protruding inwardly from the head 46, 92; and a locking pin handle 50 allowing for easy grasping of the pin 44, 90 by a user.

Thus, the locking pin operates to lock all the elements of the locking assembly together on both ends of the tubing to prevent any movement of the movable door 16 with respect to the stationary door 14.

Figure 3:
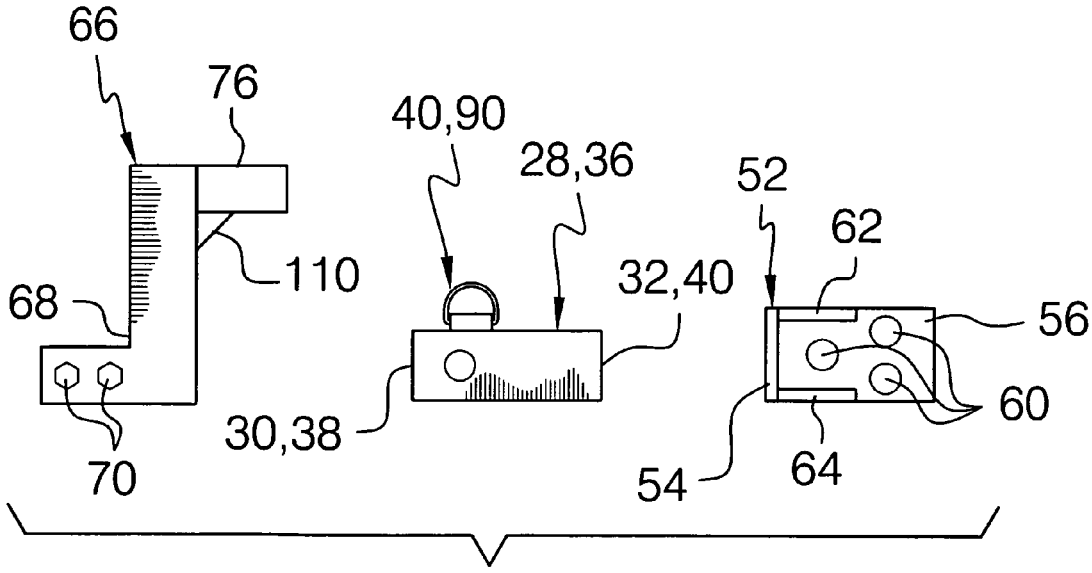
FIG. 3 illustrates a front view of bracket sleeve assembly.
Figure 4:
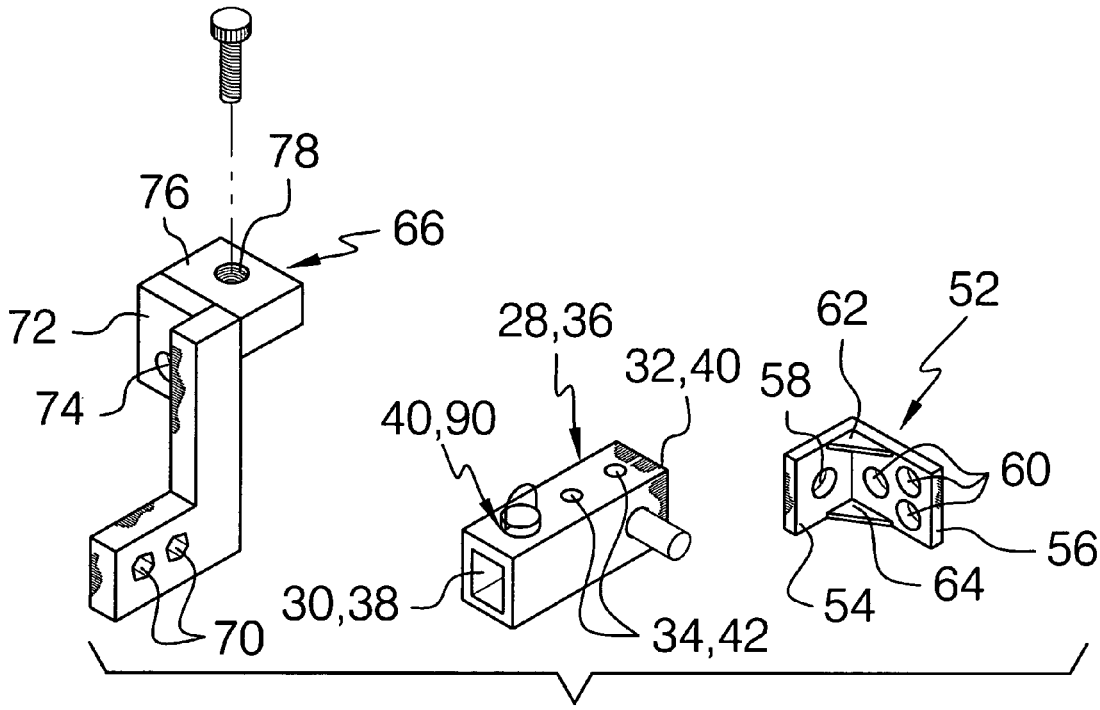
FIG. 4 illustrates a perspective view of the bracket-sleeve assembly shown in FIG. 3.

FIG. 3 illustrates a front view of bracket sleeve assembly 106. FIG. 4 illustrates a perspective view of the bracket-sleeve assembly 106 shown in FIG. 3.

A bracket assembly 106 provides a first bracket 52 and a second bracket 66 that each cooperate together at opposing ends of the tubing and sleeves to retain the tubing 18 and sleeves 28, 36 in a fixed position with respect to the sliding door assembly 10. Each of the first and second brackets 52, 66 are adapted to securely mount to an opposing end of either the movable door 16 or the stationary door 14.

The first bracket 52 has a first bracket element 54, and a second bracket element 56 that are formed at a substantially 90° angle with respect to each other.

The first bracket first element 54 has at least hole 58 disposed therethrough and the first bracket second element 56 has one or more holes 60 disposed therethrough, wherein each of the holes 54, 60 are adapted to receive a conventional fastening member therethrough for securely mounting the first bracket 52 to a frame associated with the stationary door 14. Also, the first bracket cross bracing members 62, 64 are angularly disposed between the first and second elements of the first bracket.

The first bracket is adapted to fixably secure to the stationary door 14 via conventional fastening means such as, but not limited to screws or bolts.

The second bracket 66 has first member 68, a second member 72 and a third member 76.

The second bracket first member 68 is adapted to fixedly secure to the movable door 16 and has holes 70 for receiving a fastener to mount the door 16.

The second bracket second member 72 is formed at a substantially 90° angle with respect to the first member 68.

The second bracket second member has at least one hole disposed therethrough for receiving a fastener to further secure the bracket 66 to the movable door 16.

The second bracket third member 76 has a threaded bore 78 disposed therethrough adapted to engage and receive a conventional fastening device. In operation, the fastening device engages a top planar portion of the second sleeve to secure the sleeve in a fixed position relative to the door assembly. Alternatively, the conventional fastening device may be received by a corresponding hole disposed through the sleeve.

When the double lock system is assembled and secured by both the brackets defining the bracket assembly, if a force is applied to the sleeve to lift the sleeve and the tubing in an upward manner when each are horizontally disposed between the stationary door and the movable door, the fastening device secured by the second bracket applies an opposing force to the sleeve and bar thereby preventing any upward movement of the sleeve and tubing.

Optionally, the third member 76 may be hingeably attached to the second member 72 via an optional hinge 110 so that the third member may move between a first and a second position. The optional hinge member may be disposed between second member and third member to allow the third member to hingeably engage the second member such that in operation when the bracket is not being used, the third member may hingeably move between an open first position forming a 90° angle with a second member and a second closed position wherein the third member formed a 0° with the second member. The hinge member adapted to hingeably move the third member between a first and a second position to prevent interference between the movable door and a door frame when the second bracket is not in use In operation, initially, one or more end sleeves engage the tubing 18 to form an adjustable width assembly. Each sleeve has an associated locking pin that operates to fix the sleeve in a fixed position relative to a respective end of the tubing. Next, the sleeve is placed between the cross bracing members of the first bracket such that the closed end of the first sleeve is flush with the second element of the first bracket.

Additionally, the second end of the tubing is positioned along a track of the stationary door such that it engages the closed end of the second sleeve. The fastener associated with the second bracket third member may then be disposed through the threaded bore of the second bracket third member to engage a top planar portion of the second sleeve to prevent movement in an upward direction of the sleeve, thereby securing the tubing 18 in a fixed position between the movable door 16 and the fixed door 14.

The double lock system 12 may be positioned above a track that is part of the sliding door assembly 10 and may be elevated on or slightly above the track by an optional foot or plurality of feet 108, as illustrated in FIG. 5. The feet 108 are mounted underneath the tubing section 18 and are adapted to elevate the tubing section above a track associated with the sliding door assembly. By elevating the assembly 12, the assembly may be properly oriented to allow the assembly to remain in a substantially horizontal orientation when positioned on the track thereby of the lock assembly 12 with respect to the track in a non-horizontal orientation.

It is contemplated that the first and second brackets may be positioned interchangeably or that the double lock system may provide a combination of two of each types of brackets or one of each brackets disposed at each end of the stationary door 14.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the aspects of the technology without departing from the spirit and scope of the appended claims.

What is claimed is:

1. A double lock system for securing a sliding door assembly having a stationary door and a movable door that moves laterally with respect to the stationary door comprising:

a tubing section;

a first sleeve adapted to receive a first end of the tubing section, the first sleeve having at least one hole disposed therethrough for receiving a locking pin therethrough;

a second sleeve adapted to receive a second end of the tubing section, the second sleeve having at least one hole disposed therethrough for receiving a locking pin therethrough; and a bracket assembly, the bracket assembly adapted to receive the first and second sleeves, wherein the tubing section, the at least one sleeve and the bracket assembly cooperate to secure the locking system in a fixed position relative to the sliding door assembly the bracket assembly, and including a first bracket adapted to fixedly be secured to either a stationary or a movable door having a first element having at least one hole disposed therethrough for receiving an associated fastener therethrough to mount and secure the first bracket to either the stationary or the movable door of the door lock assembly, a second element substantially at a 90° angle to the first element, the second element has at least one hole disposed therethrough also for receiving an associated fastener therethrough to mount and secure the first bracket to either the stationary door or the movable door of the sliding door assembly, and at least one cross-bracing element disposed between the first element and the second element, and wherein the first element and the second element cooperate with the cross-bracing element to receive the at least one sleeve and to retain the at least one sleeve in a fixed position relative to the bracket, a second bracket, the second bracket having a first member having at least one hole disposed therethrough for receiving an associated fastener therethrough to mount and secure the second bracket to either the stationary or the movable door, a second member at a substantially 90° angle from the first element having an associated hole disposed therethrough also for receiving an associated fastener therethrough to further secure the second bracket to the movable door, and a third member at a substantially 90° angle to both the first member and the second member having an associated hole threaded bored disposed of receiving a fastener which may be adjusted to retain the tubing section in a fixed position relative to the double lock system securing the sliding door assembly.

2. The double lock system of claim 1, wherein the tubing section comprises:

a first end of the tubing section;

a second end of the tubing section opposing the first end of the tubing section; and a plurality of holes associated with the opposing first and second ends of the tubing sections adapted to receive a locking pin therethrough.

3. The double lock system of claim 1, wherein the second bracket further comprises:

a hinge member adapted to hingeably move the third member between a first and a second position to prevent interference between the movable door and a door frame when the second bracket is not in use.

4. The door lock assembly of claim 1, further comprising:

at least one locking pin associated with the at least one sleeve, the locking pin comprising:

a locking pin head;

a locking pin shaft integrally formed with a locking pin head; and a locking pin handle allowing for easy grasping of the locking pin by the user of the device.

5. The locking system of claim 1, further comprising:

a pin protruding outwardly from a planar surface of the at least one sleeve allowing for the sleeve to adjustably move from a first to a second position with respect to the tubing section to adjust an overall length of the sleeve and tubing section combination.

6. The locking system of claim 1, further comprising:

a plurality of feet disposed underneath the tubing section adapted to elevate the tubing section above a track associated with the sliding door assembly.

7. A double lock system for securing a sliding door assembly having a stationary door and a movable door that moves laterally with respect to the stationary door comprising:

a tubing section;

a first sleeve adapted to receive a first end of the tubing section, the first sleeve having at least one hole disposed therethrough for receiving a locking pin therethrough;

a second sleeve adapted to receive a second end of the tubing section, the second sleeve having at least one hole disposed therethrough for receiving a locking pin therethrough; and a bracket assembly, the bracket assembly adapted to receive the first and second sleeves, wherein the tubing section, the first and second sleeves and the bracket assembly cooperate to secure the locking system in a fixed position relative to the sliding door assembly, and the bracket assembly including a bracket, the bracket having a first member having at least one hole disposed therethrough for receiving an associated fastener therethrough to mount and secure the second bracket to either the stationary or the movable door, a second member at a substantially 90° angle from the first element having an associated hole disposed therethrough also for receiving an associated fastener therethrough to further secure the second bracket to the movable door, and a third member at a substantially 90° angle to both the first member and the second member having an associated hole threaded bored disposed of receiving a fastener which may be adjusted to retain the tubing section in a fixed position relative to the double lock system securing the sliding door assembly.

* * * * *